US006490835B1

(12) United States Patent
Simmons

(10) Patent No.: US 6,490,835 B1
(45) Date of Patent: Dec. 10, 2002

(54) VINYL SIDING WALL ORNAMENTATION

(76) Inventor: William G. Simmons, 241 Barnes La., Toms River, NJ (US) 08753

( * ) Notice: Subject to any disclaimer, the term of this patent is extended or adjusted under 35 U.S.C. 154(b) by 0 days.

(21) Appl. No.: 09/961,774

(22) Filed: Sep. 24, 2001

(51) Int. Cl.[7] ..... E04D 1/00

(52) U.S. Cl. ..... 52/554; 52/242; 52/518; 52/3; 52/23; 52/506.05; 52/311; 428/79; 428/904.4; 428/913.3; 40/594; 40/595

(58) Field of Search ..... 52/287.1, 311.1, 52/311.2, 554; 428/904.4, 913.3, 33, 518, 47, 54, 55, 77, 189, 195; 174/68.3; 40/595, 594, 518, 620, 618

(56) References Cited

U.S. PATENT DOCUMENTS 291,215 A * 1/1884 Moneyment ..... 428/13
4,900,604 A * 2/1990 Martinez et al. ..... 428/79
5,224,610 A * 7/1993 Veazey ..... 211/87
5,678,370 A * 10/1997 Douglass ..... 404/37
5,694,728 A * 12/1997 Heath et al. ..... 52/518
5,937,587 A * 8/1999 Zinbarg ..... 52/222
6,041,533 A * 3/2000 Lemmond, Jr. ..... 40/584
6,274,814 B1 * 8/2001 Iavarone ..... 174/100
6,279,280 B1 * 8/2001 Plager ..... 52/311.1
6,367,218 B2 * 4/2002 Lombardo ..... 52/311.2

* cited by examiner

*Primary Examiner*—Carl D. Friedman
*Assistant Examiner*—Basil Katcheves
(74) *Attorney, Agent, or Firm*—Charles I. Brodsky

(57) ABSTRACT

A vinyl siding wall ornamentation packaged as a self-contained kit including one or both of an already assembled vinyl siding design, and a plurality of vinyl siding strips to be assembled according to predetermined plan, for overlaying the wall in substantially watertight securement.

8 Claims, 3 Drawing Sheets

VINYL SIDING WALL ORNAMENTATION

CROSS-REFERENCE TO RELATED APPLICATIONS

NONE

STATEMENT REGARDING FEDERALLY SPONSORED RESEARCH OR DEVELOPMENT

Research and development of this invention and Application have not been federally sponsored, and no rights are given under any Federal program.

REFERENCE TO A MICROFICHE APPENDIX

NOT APPLICABLE

BACKGROUND OF THE INVENTION

1 Field of the Invention

This invention relates to vinyl siding installation, in general, and to the beautification of vinyl siding wall ornamentations installed on a home, in particular.

2 Description of the Related Art

As is known, vinyl siding is often installed on a home as part of a modernization of its appearance—but, more-and-more, as part of an initial construction to facilitate maintenance of the home over time. Commonly available in lengths of 12½ feet and of 4 inch width, recent advances have produced segments available for utilization with lighting blocks, electrical outlet blocks and hose bib blocks as well.

Whether installed as part of an initial construction, or later added to replace worn or weathered shingles, however, the vinyl siding strips available today come fabricated essentially in single colors only and in various shadings of primary colors. As such, the overall impression (while being much more pleasing than obtainable alternatives), tend to be on the drab side, especially on the side walls of homes where windows and/or doors appear in fewer numbers to break up a "boxy" appearance presented—frequently of 24 foot by 18 foot dimension.

As will become clear from the following description, however, such degree of uniformity given can be beautified by the teaching of this invention in allowing for vinyl siding ornamentation of the external walls which define the structure of the home to begin with.

SUMMARY OF THE INVENTION

As will become clear, the vinyl siding wall ornamentation of the invention, is packaged as a self-contained kit to include one or both of an already assembled vinyl siding design and a plurality of vinyl siding strips to be assembled according to a predetermined plan, for overlaying the external walls of the home in substantially watertight securement. As will be appreciated by those skilled in the art, the resulting effect would be to open up the entire vinyl siding industry to an attractiveness selection of designs in accordance with the desires of the homeowner. Through the availability of pre-fabricated kits, different scenes and appearances can be chosen as part of an installation, and even custom made mural-like designs can be imparted through the advances presently made with computer technology to translate a photograph, for example, into a montage of individually fitted pieces intercoupled as in a completed jigsaw puzzle.

Thus, and in accordance with the invention, the display ornamentation comprises first of all, a wall covered at least in part by previously installed strips of vinyl siding material. To that, the ornamentation adds a design to overlay the wall, with the design also composed of vinyl siding material, secured to the wall with selected ones of the strips by a watertight depiction of desired decorativeness. In a preferred embodiment of the invention, the design is packaged as a self-contained kit including one or both of an already assembled ornamentation to be secured, and a plurality of vinyl siding material strips to be assembled according to a predetermined plan in establishing the display ornamentation to be overlain. In one embodiment of the invention, the design is secured with selected ones of the strips of vinyl siding material being nailed to the previously installed vinyl siding material wall strips, and with portions of the design being flanged in interlocking relationship with the wall strips to limit water leakage behind the design. In such version, the design would include an already assembled ornamentation—for example, in the form of a floral arrangement or in such a nautical arrangement as a sailing ship, or ship's anchor.

In a second embodiment of the invention, on the other hand, the design ornamentation may include a layout plan for the predetermined assembly of individual vinyl siding material strips, which are secured to the plan subsequent to the securement of the plan to the previously installed vinyl siding wall material. Such prior securement may be by way of an adhesive sheet of water-resistant material according to the invention, with the vinyl display ornamentation then being similarly nailed to the wall through the layout plan. As an example, the layout plan may be stapled directly to the vinyl siding wall material.

In those situations where further desired, the self-contained design kit may also include, in accordance with the invention, individual vinyl siding material ornamentations to be fitted within selected ones of the vinyl siding wall strips adjacent to the corner posts of the vinyl siding installation to give to the home an even more decorous and attractive appearance.

And, and as will be appreciated, the overall effect is to give a 3-dimension look to the installed vinyl siding wall of whatever size the homeowner desires, wherever the location may be selected, and of either one of a standard, available design, or of one uniquely tailored to a homeowner's wishes through the patterning of any photograph or scene thereafter fitted together as a complete presentation. Whether through the use of flanged vinyl siding material strips or through the use of first applying adhesive sheets of water-resistant material to the previously installed wall of vinyl siding, a substantial degree of watertightness is provided in preventing leakage behind the design overlaid.

BRIEF DESCRIPTION OF THE DRAWINGS

These and other features of the present invention will be more clearly understood from a consideration of the following description, taken in connection with the accompanying Drawings, in which.

DETAILED DESCRIPTION OF THE INVENTION

Figure 1:
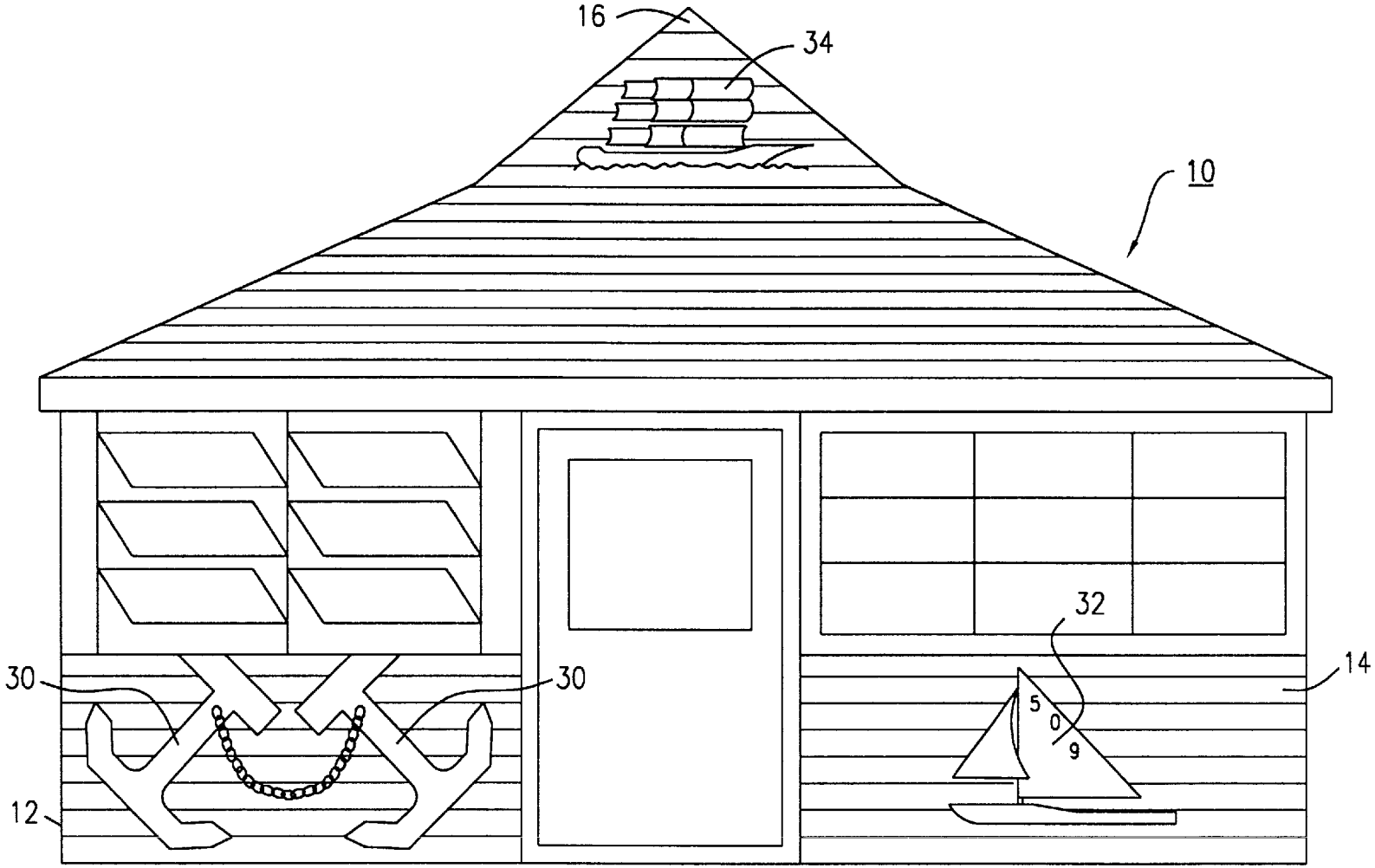
FIG. 1 is a pictorial sketch of a smaller home helpful in an understanding of the vinyl siding wall display ornamentation of the present invention.
Figure 2:
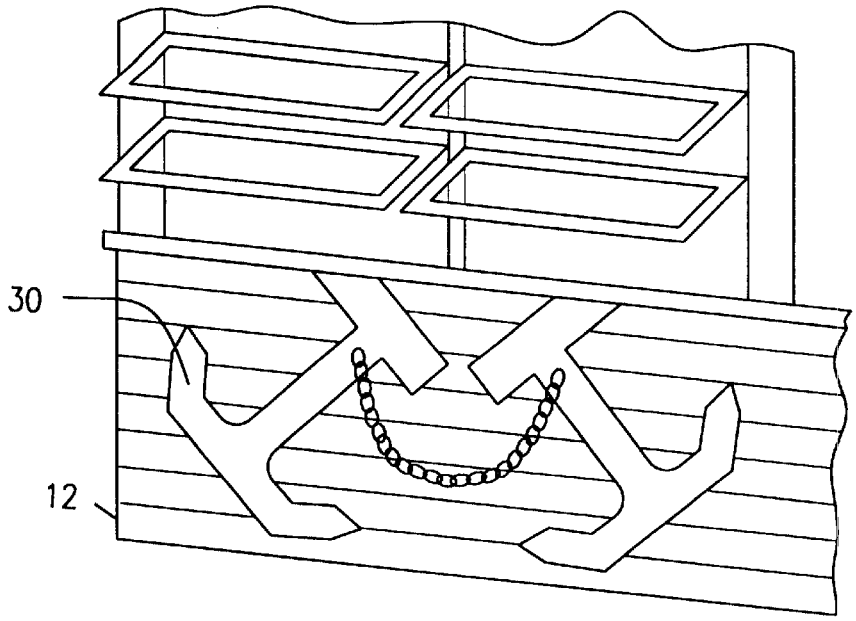
FIGS. 2 and 3 are close-up views of portions of the front wall of the home of FIG. 1.
Figure 3:
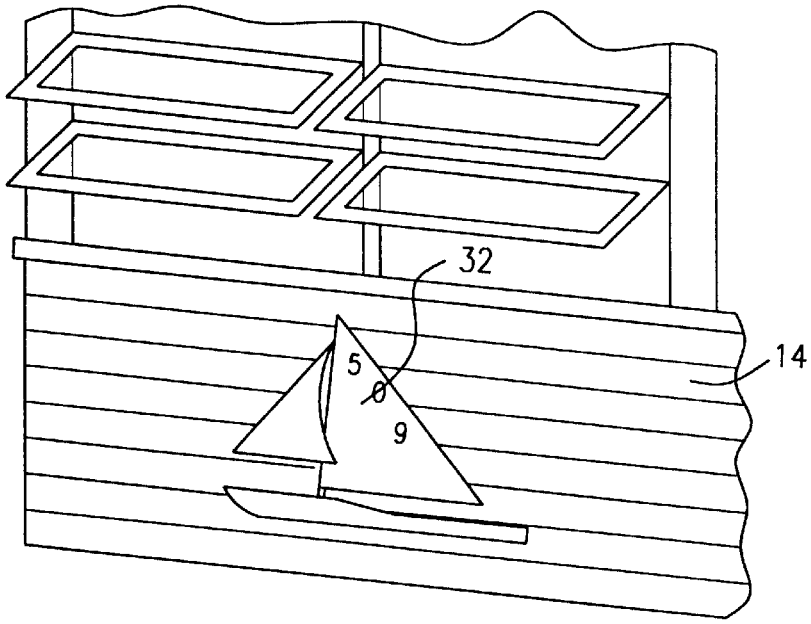
Figure 4:
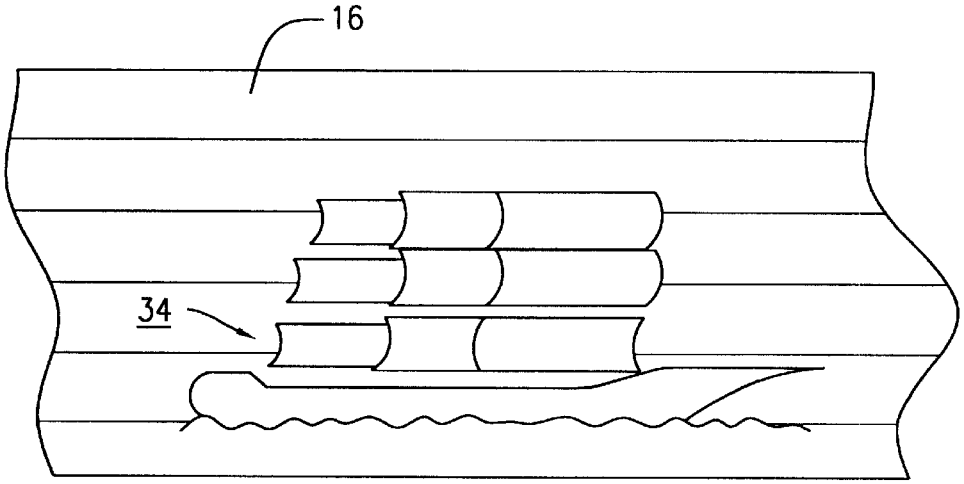
FIG. 4 illustrates a display ornamentation according to the invention as it may appear on a side wall of the home of FIG. 1.

In FIGS. 1–3, a smaller home 10 featuring the invention is depicted with three vinyl siding wall segments 12, 14, 16 adjacent the various windows, door, overhangs and roofs of the structure. Such vinyl siding walls may be installed in conventional fashion, either professionally or by the homeowner where desired. In accordance with the invention, a design to overlay the wall is similarly composed of vinyl siding material, with the design to be secured with selected ones of the vinyl siding wall strips as a substantially watertight montage of desired decorativeness. Thus, a pair of anchors 30 is shown at the section 12, a sailboat 32 with or without a house number affixed may be included at the wall section 14, and a schooner 34 may be included at the wall section 16. In FIG. 4, a larger depiction of the schooner 34 may be included on a side wall of the house 10, illustrating for example, the ability of the invention to be selected to whatever size the homeowner desires, and wherever the design is to be located. Of course, a different configuration for the schooner could be imparted at the side wall—or a completely unrelated design could be utilized instead if that be the homeowner's preference.

Figure 5:
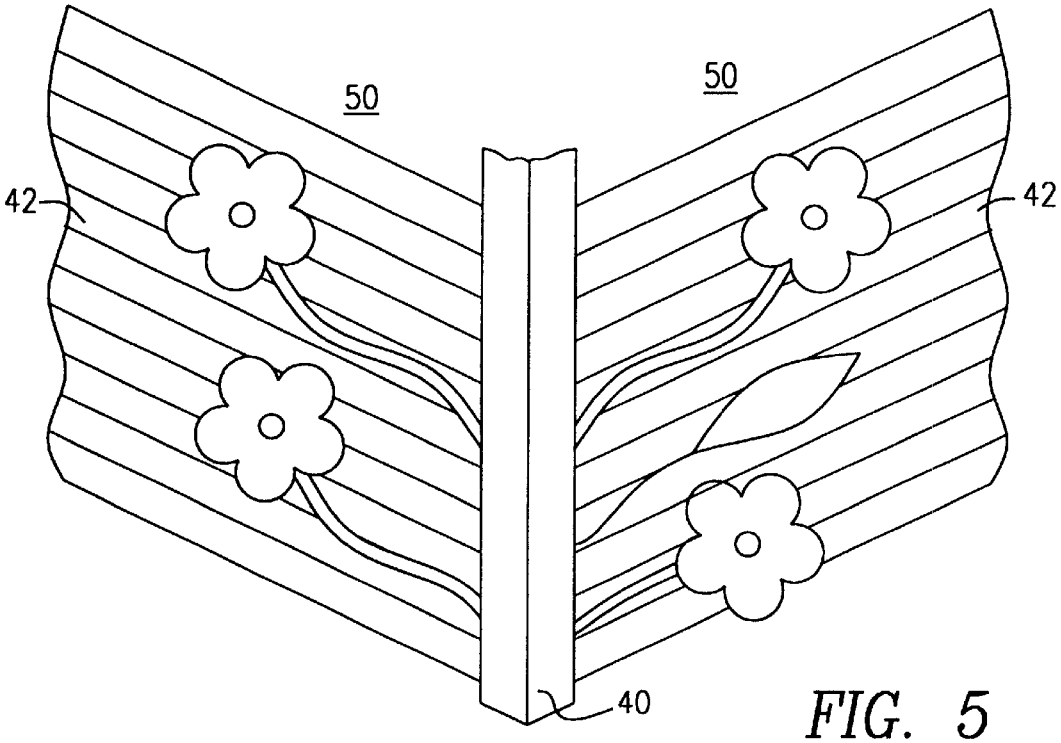
FIG. 5 is a sketch helpful in an understanding of another usage of the teachings of the invention.

In accordance with the invention, the particular design selected may be packaged as a self-contained kit including an already assembled ornamentation to be secured (as in FIGS. 1–4), or as a plurality of vinyl siding material strips to be assembled according to a predetermined plan as with the fitting of individual jigsaw puzzle pieces into a display ornamentation to be overlain. With the embodiments of FIGS. 1–4, the design selected for the securement is affixed with selected ones of the individual vinyl siding strips of the wall material by a nailing thereto—preferably with flanges further included on the design to interlock with the strips of vinyl siding material to limit water leakage behind the design. The presentations of FIGS. 1–4 thus result. Where the side walls of the structure 10 respectively meet its front and rear walls, corner posts 40 (FIG. 5) are conventionally utilized—and at such locations, vinyl siding designs may also be overlain, as with the garden scene floral arrangement 50 shown, again, with a nailing and flanging together with the strips 42 to effect the securement and limit water leakage behind the added design.

As an alternative to packaging an already assembled ornamentation within the self-contained kit with as the depictions of FIGS. 1–5, the display ornamentation of the present invention may instead follow the separation of a computer generated design onto a sheet of vinyl siding material as generated from a scanned photograph or other image chosen by the homeowner, or selected by a manufacturer for packaging as a puzzle design to be fitted into the resulting display. Such individual pieces may be packaged together as a kit, also including a layout plan for securement to the vinyl siding covered wall—with the individual pieces then to be fitted into place in accordance with its indicated position on the layout. In such utilization, the layout plan may be composed of a sheet of water-resistant material which is adhesively installed onto the vinyl siding wall prior to the securement to it of the individual vinyl siding display pieces. Such pieces, as with the arrangements of FIGS. 1–5, could be secured by a nailing through the layout plan into the vinyl siding covered wall. To further hold the adhesive backed sheet of water-resistant material in place, such layout plan may be stapled to overlay the vinyl sided covered wall.

While there have been described what are considered to be preferred embodiments of the present invention, it will be readily appreciated by those skilled in the art that other modifications can be made without departing from the scope of the teachings herein of being able to convert an otherwise plain appearance of a vinyl sided covered wall to one depicting ornamentation in 3-dimension of selected objects or scenes in accordance with user preferences.

As will be understood, this applies whether the vinyl siding be of traditional clapboard style or dutchlap, frequently representing two pieces of wood plank siding applied with a 4 inch or 5 inch exposure to "the weather"—for both panels of vinyl siding formed to represent cedar shakes of various textures and exposures, or half-round pieces. As is known, such siding panels usually include a "lock" or clip at the top of the panel with slots to receive nails above, and a "bottom lock" or clip section on the back to secure the upper piece to a lower one, with the system continuing up a wall until the desired coverage is completed. With the vinyl siding also being typically accompanied by accessories to start, finish, trim, corner, for example, the installation, the intent in each instance is to replicate a wooden exterior covering, mimicking cedar siding, redwood siding and various other wooden veneers and facades, or of a brick and masonry texture. All these vinyl products, however, strive to give the appearance of a wood product, even touting the wood grain effect or the brushed wood finish—with some going as far as to appear as a rough-sewn cedar with all the different shades of color found in wood. With the present invention, on the other hand, an "accent" and "look" can be given to the exterior of a building, in a decorous manner, as well as to personalize and bring attention to an area where people seek to adorn their homes with icons and symbols of various shapes, sizes, compositions and types. With the invention, a vinyl siding panel results in the form of one which has a top lock with a nailing hem above it, and a bottom rear lock which clips into the top lock of the previous panel fastened in continuing the systematic coverage of the wall. As will be appreciated by the skilled artisan, on the other hand, with the invention, the siding panel which results is selected "not" to resemble wood of any kind, but is instead colored and formed to be a part of a system which resembles the design or background setting to be applied at an area of the wall where a particular desired motif is to be located. As further described, the design could be in the form of a "kit", to be introduced further along in the siding "puzzle" in completing a decorous scene of any variety desired. A whole new area of decoration thus can result—and in such respect, therefore, the teachings of the invention should be read in light of the claims appended hereto for a true understanding of the scope of the invention.

I claim:

1. A display ornamentation comprising:

a wall covered at least in part by strips of vinyl siding material;

a design to overlay said wall also composed of vinyl siding material, with said design being secured with selected ones of said strips as a substantially watertight montage of desired decorativeness;

and with said design being packaged as a self-contained kit including one or both of an already assembled ornamentation to be secured, and a plurality of vinyl siding material strips to be assembled according to predetermined plan in establishing the display ornamentation to be overlain;

and wherein said design including a plurality of vinyl siding material strips additionally includes as part of said self-contained kit a layout plan for the predetermined assemblage thereof, for a first securement to overlay said wall, prior to the securement of said vinyl siding material strips thereto.

2. The display ornamentation of claim 1 wherein said design is secured with selected ones of said strips of vinyl siding material by a nailing thereto.

3. The display ornamentation of claim 2 wherein portions of said design are flanged in interlocking with strips of vinyl siding material to limit water leakage therebehind.

4. The display ornamentation of claim 1, wherein said layout plan is composed of an adhesive sheet of water-resistant material.

5. The display ornamentation of claim 4 wherein said plurality of vinyl siding material strips of said design are secured with selected ones of said vinyl siding material strips of said wall by a nailing through said layout plan.

6. The display ornamentation of claim 5 wherein said layout plan is stapled to overlay said wall.

7. The display ornamentation of claim 5 wherein said plurality of vinyl siding material strips are each of a width substantially equal to the width of individual ones of said vinyl siding material wall strips.

8. The display ornamentation of claim 1 wherein said design packaged as a self-contained kit also includes ornamentation of vinyl siding material to be fitted within selected ones of said vinyl siding material wall strips adjacent to individual corner posts of said wall.

* * * * *